US006573829B2

(12) United States Patent
Ebara

(10) Patent No.: US 6,573,829 B2
(45) Date of Patent: Jun. 3, 2003

(54) OIL PROPER AMOUNT INFORMING APPARATUS FOR ENGINE

(75) Inventor: Katsumi Ebara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/902,646

(22) Filed: Jul. 12, 2001

(65) Prior Publication Data

US 2002/0014957 A1 Feb. 7, 2002

(30) Foreign Application Priority Data

Jul. 12, 2000 (JP) ..... 2000-211679

(51) Int. Cl.[7] ..... B60Q 1/00

(52) U.S. Cl. ..... 340/449; 340/450.3; 340/459; 340/461; 340/691.6

(58) Field of Search ..... 340/584, 438, 340/439, 449, 450.2, 450.3, 457, 457.4, 501, 525, 870.16, 870.17, 691.1, 691.5, 691.6, 461, 462, 459, 450, 815.4; 73/290 R, 292, 295, 291; 701/104, 1, 29; 123/142.5 R, 41.1, 41.33

(56) References Cited

U.S. PATENT DOCUMENTS 4,677,847 A * 7/1987 Sawatari et al. ..... 73/64
5,742,920 A * 4/1998 Cannuscio et al. ..... 701/102
5,783,993 A * 7/1998 Briski et al. ..... 340/525
6,301,947 B1 * 10/2001 McCombs, Jr. ..... 73/290 R

* cited by examiner

*Primary Examiner*—Benjamin C. Lee
(74) *Attorney, Agent, or Firm*—Birch, Stewart, Kolasch & Birch, LLP

(57) ABSTRACT

An oil proper amount informing apparatus for engines capable of simply checking whether or not a remaining amount or level of oil is proper even if the period of time of warming-up varies. An oil level gauge mounted to an oil reservoir unit, a temperature sensor for detecting the temperature of oil, and temperature indicating means for indicating the temperature on the basis of a detected signal of the temperature sensor are provided. The temperature indicating means indicates the temperature of oil in either of a plurality of divided regions H, M, and L, each of which has a predetermined width or range of temperature. The oil level gauge is provided with the indicating regions H, M, and L, each of which indicates an proper amount of oil at a position corresponding to the proper amount of oil in each of the temperature regions H, M, and L.

18 Claims, 2 Drawing Sheets

OIL PROPER AMOUNT INFORMING APPARATUS FOR ENGINE

BACKGROUND OF THE INVENTION

1. Field of the Invention

The present invention relates to an oil proper amount informing apparatus for engines, and more particularly to an oil amount informing apparatus that is suitably used for engines mounted on a vehicle.

2. Description of Background Art

It is known to provide an engine mounted on a vehicle with an oil reservoir unit. Oil stored in the oil reservoir unit is supplied to the engine for lubricating movable portions and cooling the engine.

In order to reliably perform such lubricating operation and cooling operation using the oil, it is needed to properly store the remaining amount of oil. For this purpose, an oil level gauge has been provided to check the remaining amount of oil.

Such a check of the remaining amount of oil with the oil level gauge has been generally carried out by pulling out the oil level gauge after the engine has been warmed-up for a predetermined period of time.

However, the method of checking the remaining amount of oil as described above has following problems.

That is, the checking of the remaining amount of oil after the warming-up of the engine for a predetermined period of time is performed for checking the remaining amount of oil more precisely in a state in which the temperature of the oil is stabilized, thereby checking the remaining amount of oil in a state when the variation in volume of the oil is stable.

However, the period of time for the warming-up varies depending on users, and therefore the remaining amount checked oil varies depending on the oil temperature measured upon checking of the remaining amount of oil.

SUMMARY AND OBJECTS OF THE INVENTION

In view of the foregoing, the present invention has been made, and an object of the present invention is to provide a proper amount of oil informing apparatus capable of providing a more simply checking of whether or not a remaining amount of oil is proper even if the period of time of warming-up varies.

In order to achieve the above object, a proper amount of oil informing apparatus for an engine according to the present invention is characterized by including an oil level gauge mounted to an oil reservoir unit; a temperature sensor for detecting the temperature of oil; and temperature indicating means for indicating the temperature on the basis of a detected signal of said temperature sensor means; wherein said temperature indicating means indicates an oil temperature in either of a plurality of divided regions, each of which has a predetermined width or range of temperature, and said oil level gauge is provided with a plurality of indicating regions for indicating a proper amount of oil which corresponds to each of said temperature regions of said temperature indicating means.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
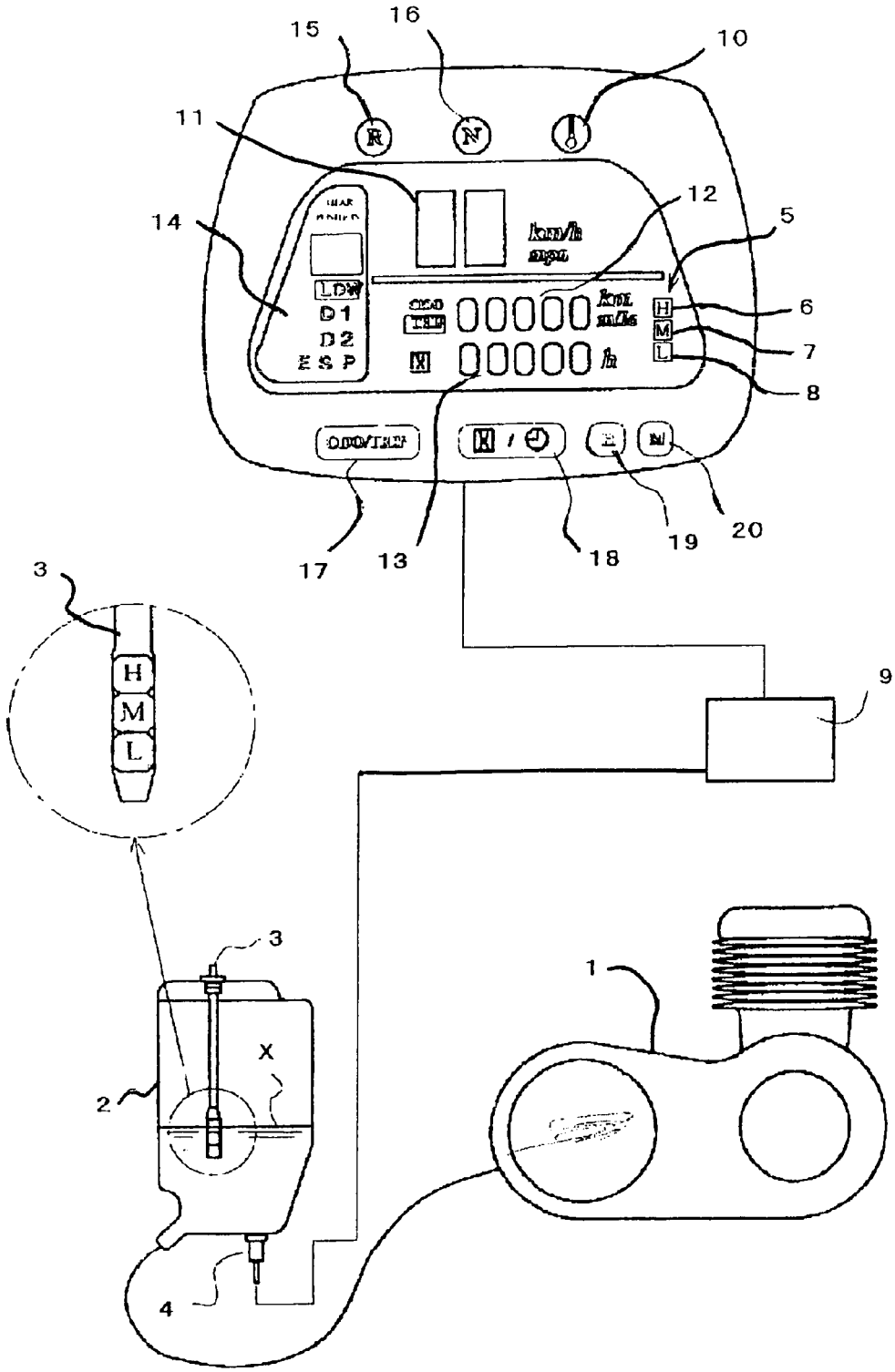
FIG. 1 a systematic diagram showing one embodiment according to the present invention.

Hereinafter, one embodiment of the present invention will be described with reference to the drawings. Referring to FIG. 1, an oil proper amount informing apparatus according to the embodiment generally includes an oil level gauge 3 mounted to an oil reservoir unit 2 for an engine 1; a temperature sensor 4 for detecting a temperature of oil X; and a temperature indicating means 5 for indicating an oil temperature based on a detected signal from the temperature sensor 4. The temperature indicating means 5 indicates an oil temperature in either of a plurality of divided regions (H, M, and L), each of which has a predetermined width or range of temperature. The oil level gauge 3 is provided with a plurality of indicating regions (H, M, and L) for indicating a proper amount of oil which corresponds to each of the temperature regions (H, M, and L) of the temperature indicating means 5.

Figure 2:
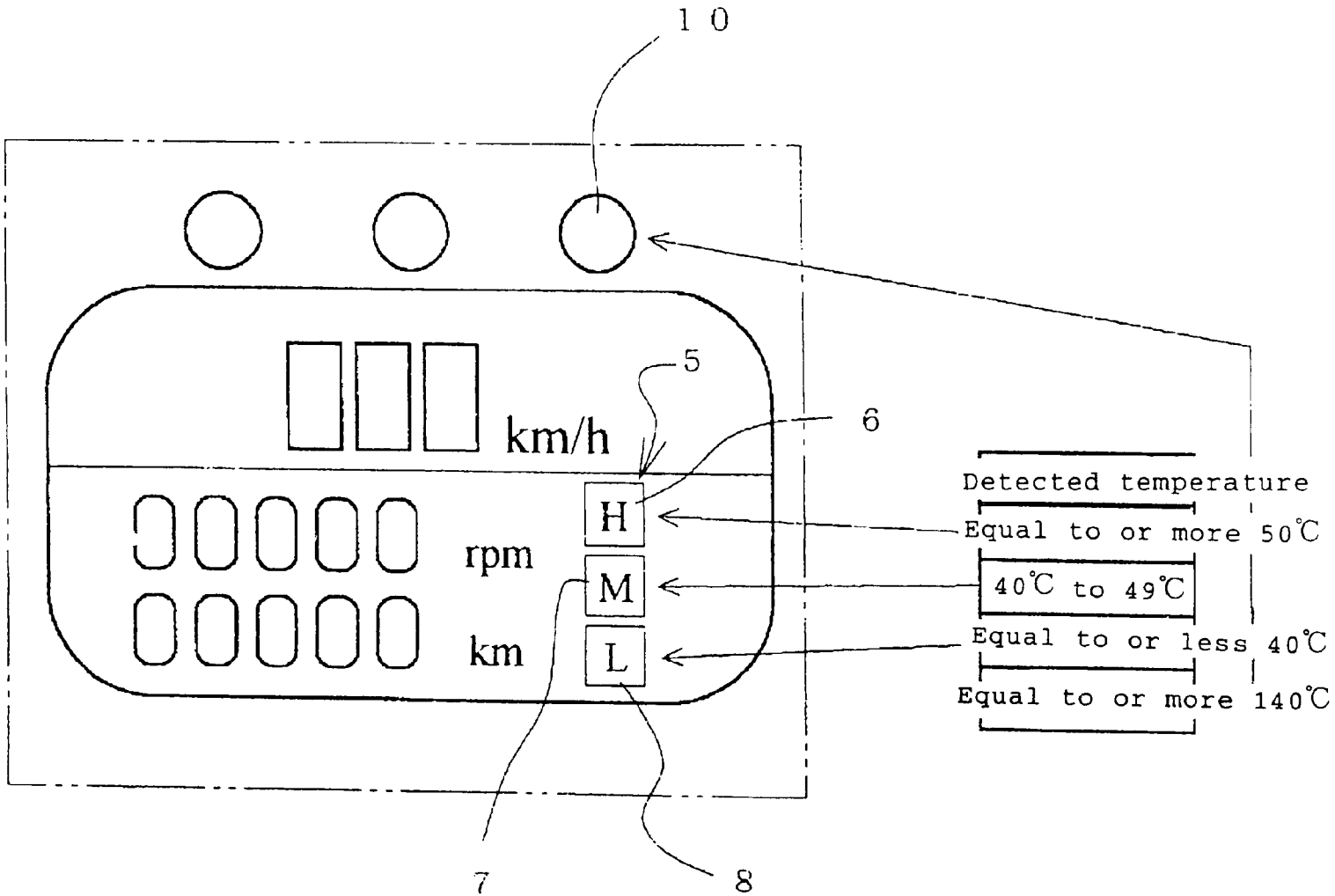
FIG. 2 is an enlarged schematic diagram of a principal part showing one embodiment according to the present invention.

To be more specific, the temperature indicating means 5 is, for example, mounted on an indicator panel of the vehicle, and has three temperature regions H, M, and L, each of which has a predetermined width or range (in this embodiment, set to a temperature width or range of 10 degrees C. as shown in FIG. 2). Thus, an oil temperature measured is displayed in either of the temperature regions H, M, and L.

As shown in FIG. 2, the temperature regions H, M, and L are set as follows: H=50 degrees C. or more, M=40 degrees C. to 49 degrees C., and L=40 degrees C. or less.

The temperature regions H, M, and L are displayed by writing the letters of H, M, and L on the surfaces of the indicator lamps 6, 7 and 8 respectively, to be thus indicated on the temperature indicating means 5 by illuminating the indicator lamps 6, 7 and 8.

Oil X has a property that its volume varies depending on its temperature. The volume which corresponds to each of the temperature regions H, M, and L set on the temperature indicating means 5 is uniquely fixed. As a result, a proper amount of oil corresponding to each of the temperature regions H, M, and L is also fixed.

The oil level gauge 3 is provided with the indicating regions H, M, and L, each of which indicates a proper amount of oil at a position corresponding to the proper amount of oil in each of the temperature regions H, M, and L described above.

On the other hand, a control means 9 such a microcomputer selects the temperature region H, M, or L on the basis of a temperature measurement signal from the temperature sensor 4. Then, based on the selected temperature region H, M, or L, the control means 9 selects the indicator lamp 6, 7 or 8 to be illuminated, and lights the lamp thus selected.

In this embodiment, the temperature indicating means 5 is also provided with a warning lamp 10 which warns a user in the event the temperature of oil excessively rises.

At the time when the temperature of oil X reaches 140 degrees C. or more as shown in FIG. 2, the warning lamp 10 is illuminated on the basis of a signal from the control means 9 to inform a user of the excessive rise in the temperature of oil.

In this embodiment, the oil tank is illustrated as the oil reservoir unit 2; however, an oil pan mounted to the engine 1 may be adopted as the oil reservoir unit 2.

The temperature sensor 4 may be mounted to any location other than the oil reservoir unit 2 as long as it can detect the temperature of the oil X.

On the other hand, the indicator panel includes a speed indicator unit 11, a travel distance indicator unit 12, a time indicator unit 13, a shift position indicator unit 14, a reverse indicator lamp 15, and a neutral indicator lamp 16. The speed indicator unit 11 indicates a vehicle speed switchably either in kilometers or in miles. The travel distance indicator unit 12 switchably indicates either an integrated travel distance or a travel distance from any point of time. The time indicator unit 13 switchably indicates either an hour or a travel time. The shift position indicator unit 14 indicates shift positions. The reverse indicator lamp 15 indicates that the gear shift is set to a reverse position. The neutral indicator lamp 16 indicates that the gear shift is set to a neutral position. The indicator panel also includes a distance indication changing-over switch 17, a time indication changing-over switch 18, an hour reset button 19, and a minute reset button 20. The distance indication changing-over switch 17 changes over the indication of a travel distance on the travel distance indicator unit 12. The time indication changing-over switch 18 changes over the indication on the time indicator unit 13. The hour reset button 19 adjusts "hour" indicated on the time indicator unit 13. The minute reset button 15 adjusts "minute."

In the oil proper amount informing apparatus for engines, according to this embodiment, configured as described above, in the case where the temperature of oil X is in the temperature region H, when the remaining amount of oil is proper, an oil level in the oil reservoir unit 2 is located in the indicating region H; when the remaining amount of oil is more than the proper amount, the oil level is located above the indicating region H; and when the remaining amount of oil is less than the proper amount, the oil level is below the indicating region H.

The same is true for the case where the temperature of oil X is in each of the temperature regions M, L.

Like this, in the embodiment, since the temperature of oil is indicated and the proper amount of oil corresponding to the temperature of oil X is indicated on the oil level gauge 3, the proper amount of oil is accurately checked even if the temperature of oil X varies due to the different idling-operation time of the engine.

While the preferred embodiment of the invention has been described using various shapes and dimensions of components, such description is for illustrative purposes only, and it is to be understood that changes and variations may be made according to design requirements.

As described above, according to the oil proper amount informing apparatus for engines, of the present invention, since the temperature of oil is indicated and the proper amount of oil corresponding to the temperature of oil is indicated on the oil level gauge, the proper amount of oil is easily checked even if the temperature of oil varies due to the different idling-operation time of the engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil proper amount informing apparatus for an engine, comprising:

an oil gauge mounted on an oil reservoir unit;

a temperature sensor for detecting the temperature of oil; and temperature indicating means adapted to be mounted on an indicator panel of a vehicle for indicating the temperature on the basis of a detected signal of said temperature sensor means;

wherein said temperature indicating means indicates an oil temperature in a selected one of a plurality of divided regions, each of which has a predetermined range of temperature, and said oil level gauge is provided with a plurality of indicating regions for indicating a proper amount of oil which corresponds to each of said temperature regions of said temperature indicating means.

2. The oil proper amount informing apparatus for an engine according to claim 1, wherein a first predetermined range of temperature is above 50 degrees C.

3. The oil proper amount informing apparatus for an engine according to claim 2, wherein a first predetermined level of oil is determined for said first predetermined range of temperature.

4. The oil proper amount informing apparatus for an engine according to claim 1, wherein a second predetermined range of temperature is from 40 to 49 degrees C.

5. The oil proper amount informing apparatus for an engine according to claim 4, wherein a second predetermined level of oil is determined for said second predetermined range of temperature.

6. The oil proper amount informing apparatus for an engine according to claim 1, wherein a third predetermined range of temperature is below 40 degrees C.

7. The oil proper amount informing apparatus for an engine according to claim 6, wherein a third predetermined level of oil is determined for said third predetermined range of temperature.

8. The oil proper amount informing apparatus for an engine according to claim 1, and further including a warning lamp that is illuminated when the temperature of the oil exceeds a fourth predetermined temperature.

9. The oil proper amount informing apparatus for an engine according to claim 8, wherein said fourth predetermined temperature is 140 degrees C. or above.

10. An apparatus for indicating an oil condition of an engine, comprising:

an oil level gauge mounted on an oil reservoir unit for determining a level of oil in the oil reservoir and for generating a signal based on the level of oil;

a temperature sensor for detecting a temperature of oil and for generating a signal based on the temperature of oil; and temperature indicator adapted to be mounted on an indicator panel of a vehicle for indicating the temperature based on the signal from the temperature sensor;

a controller for comparing the level of oil for each of a plurality of ranges of oil temperature;

wherein said temperature indicator indicates an oil temperature in a selected one of the plurality of predetermined ranges of temperature as an output of said controller for comparing the oil level with a plurality of indicating regions for indicating a proper level of oil which corresponds to each of said temperature regions of said temperature indicator.

11. The apparatus for indicating an oil condition of an engine according to claim 1, wherein a first predetermined range of temperature is above 50 degrees C.

12. The apparatus for indicating an oil condition of an engine according to claim 11, wherein a first predetermined level of oil is determined for said first predetermined range of temperature.

13. The apparatus for indicating an oil condition of an engine according to claim 10, wherein a second predetermined range of temperature is from 40 to 49 degrees C.

14. The apparatus for indicating an oil condition of an engine according to claim 13, wherein a second predetermined level of oil is determined for said second predetermined range of temperature.

15. The apparatus for indicating an oil condition of an engine according to claim 10, wherein a third predetermined range of temperature is below 40 degrees C.

16. The apparatus for indicating an oil condition of an engine according to claim 15, wherein a third predetermined level of oil is determined for said third predetermined range of temperature.

17. The apparatus for indicating an oil condition of an engine according to claim 10, and further including a warning lamp that is illuminated when the temperature of the oil exceeds a fourth predetermined temperature.

18. The apparatus for indicating an oil condition of an engine according to claim 17, wherein said fourth predetermined temperature is 140 degrees C. or above.

* * * * *